US007819333B2

(12) United States Patent
Lou et al.

(10) Patent No.: US 7,819,333 B2
(45) Date of Patent: Oct. 26, 2010

(54) AIR CONDITIONING CIRCUIT CONTROL USING A THERMOSTATIC EXPANSION VALVE AND SEQUENCE VALVE

(75) Inventors: Zheng D. Lou, Plymouth, MI (US); Thomas J. Joseph, Commerce, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 406 days.

(21) Appl. No.: 12/123,865

(22) Filed: May 20, 2008

(65) Prior Publication Data

US 2009/0288434 A1 Nov. 26, 2009

(51) Int. Cl.
*F25B 41/04* (2006.01)

(52) U.S. Cl. ..... 236/92 B; 62/222; 62/296

(58) Field of Classification Search ..... 236/92 B, 236/93 R; 62/222, 224, 225, 296
See application file for complete search history.

(56) References Cited

U.S. PATENT DOCUMENTS 2,573,522 A * 10/1951 Watt ..... 251/51
4,542,852 A * 9/1985 Orth et al. ..... 236/92 B
5,597,117 A * 1/1997 Watanabe et al. ..... 236/92 B
6,325,296 B1 12/2001 Dayton
6,375,085 B1 4/2002 Martin et al.
6,394,360 B2 * 5/2002 Watanabe et al. ..... 236/92 B
2002/0109012 A1 * 8/2002 Watanabe et al. ..... 236/92 B
2009/0045264 A1 * 2/2009 Lou et al. ..... 236/92 B

* cited by examiner

*Primary Examiner*—Marc E Norman
(74) *Attorney, Agent, or Firm*—Frank G. McKenzie; MacMillan, Sobanski & Todd, LLC

(57) ABSTRACT

A valve assembly for an air conditioning system includes a liquid line port pressurized at a discharge pressure, an evaporator inlet port pressurized at a suction pressure, a sequence valve for controlling a first flow path between the liquid line port and an outlet in response to a differential between the discharge pressure and the suction pressure, and a thermostatic expansion valve that includes an actuator and an expansion valve member for controlling a second flow path between the outlet and the evaporator inlet port in response to a pressure differential across the actuator.

17 Claims, 7 Drawing Sheets

AIR CONDITIONING CIRCUIT CONTROL USING A THERMOSTATIC EXPANSION VALVE AND SEQUENCE VALVE

BACKGROUND OF THE INVENTION

1. Field of the Invention

This invention relates generally to an apparatus for an air conditioning system, and, in particular, to a thermostatic expansion valve.

2. Description of the Prior Art

A thermal, or thermostatic, expansion valve (TXV) is widely used in air conditioning systems to control the superheat at the evaporator outlet. A TXV throttles refrigerant and generates a hissing noise. This noise is especially prominent when the compressor is started, i.e., when the refrigerant flowing through the TXV has high vapor content or low sub-cooling and the flow rate has a transient peak because of the TXV dynamics and the resulting peak valve opening.

To resolve this problem, the size of the valve opening may be reduced by design, but this may unduly limit the cool-down performance of the system. Furthermore, it does not resolve the issue of rapid valve opening at the compressor startup and thus has limited effect according to experimental data.

Another solution to this problem is to add screens at the TXV inlets and outlets, but empirical evidence shows that such screens have only a limited effect in reducing the hiss noise.

Gradually opening the TXV allows more time for the high pressure side of the refrigerant loop to be pressurized, thereby reaching a more sub-cooled state, absorbing residual vapor, and reducing the initial refrigerant flow rate. As a result, the hissing noise through the thermostatic expansion valve shortly after compressor startup is minimized.

If the liquid inlet tube of the TXV has a substantial segment elevated relative to the TXV liquid inlet port, such that a substantial amount of refrigerant adjacent to the liquid inlet port remains liquid before the compressor startup or between the compressor startups, then the vapor stays at the peak portion of the inlet tube and the volume of the hissing noise may be reduced.

There is a need in the industry for a sequencing feature in a conventional TXV, which may be provided by a sequence valve that opens only after the system pressure differential reaches a predetermined value. In this case, substantial throttling of refrigerant starts only after the liquid line is substantially sub-cooled, and the effective throttling or metering opening either does not overshoot or remains to be small for a substantial period of time at compressor-on.

SUMMARY OF THE INVENTION

A valve assembly for an air conditioning system includes a liquid line port pressurized at a discharge pressure, an evaporator inlet port pressurized at a suction pressure, a sequence valve for controlling a first flow path between the liquid line port and an outlet in response to a differential between the discharge pressure and the suction pressure, and a thermostatic expansion valve that includes an actuator and an expansion valve member that controls a second flow path between the outlet and the evaporator inlet port in response to a pressure differential across the actuator.

The system combines a TXV and a sequence feature or sequence valve that opens only after the system pressure differential reaches a predetermined value. The overall or substantial refrigerant throttling, therefore, starts only after the contents of the liquid line is substantially sub-cooled, even then the overall effective metering area is limited.

Instead of directly interfering with the pressure in the pressure chamber to delay opening of the TXV valve member, the effective opening, when considering the combination of a TXV and the sequence feature or valve, is slowed or delayed due to the function of a sequence valve, which opens the inlet or liquid line and fluid flow to the TXV only after the system has reached a pre-determined system pressure differential, thus achieving slower/smaller overall effective valve opening and a fair amount of sub-cool and/or vapor absorption within the liquid line.

The sequence valve, therefore, is effective in reducing the hissing sound. The function of the sequence valve makes it easier to calibrate or define the system pressure differential, which is a predetermined pressure differential at which refrigerant flow opens. A TXV that incorporates the sequence valve has less potential for physical and functional interference and entanglement between the hiss noise reduction mechanism and the thermal expansion mechanism, and is, therefore, more robust.

The scope of applicability of the preferred embodiments will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
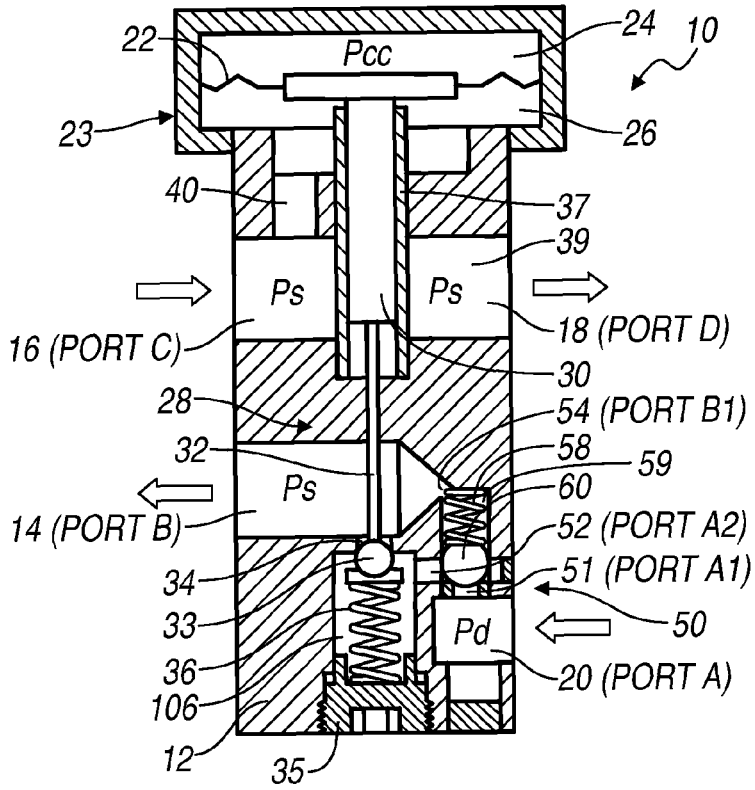
FIG. 1 is a cross sectional view through a thermostatic expansion valve having an integrated sequence valve.

Referring now to the drawings, there is illustrated in FIG. 1 a thermostatic expansion valve (TXV) 10 that includes a valve body 12 formed with an evaporator inlet port 14 (Port B) and an evaporator outlet port 16 (Port C), which ports communicate with an evaporator (not shown). Valve body 12 further includes a suction line port 18 (Port D), which is connected by a suction line to the inlet of a compressor, and a liquid line port 20 (Port A), which is connected by a liquid line to the outlet of a condenser via a receiver.

A diaphragm 22 located in a cavity of a power assembly or charge assembly 23 (which is assembled on the valve body 12) separates a charge chamber 24 from a pressure chamber 26. A valve assembly (i.e., a traditional TXV valve assembly) 28 is coupled to and actuated by diaphragm 22 in a manner such that the valve assembly 28 opens and closes a fluid connection between liquid line port 20 (Port A) and the evaporator inlet port 14 (Port B). The valve assembly 28 includes a temperature sensor 30, which is coupled to a first end of a rod 32. The opposite end of rod 32 is coupled to a valve member 33, which alternately engages and disengages a valve seat 34. A TXV set spring 36, situated inside a TXV spring chamber 106, continually urges valve member 33 to engage seat 34 and to close the valve 28. An adjusting nut 35, longitudinally adjustable within the valve body 12 and contacting an end of TXV set spring 36, adjusts the compression force of the TXV set spring 36.

A sleeve 37 surrounds the temperature sensor 30 and guides its movement and thus that of the rod 32 in a vertical direction as the valve member 33 is opened and closed.

A sensor chamber 39 is located within the TXV 10 between the evaporator outlet port 16 and the suction line port 18. A flow passage 40, which offers insignificant flow resistance, provides an unrestricted flow connection between the pressure chamber 26 and the sensor chamber 39. The flow passage 40 equalizes the pressure in pressure chamber 26 and sensor chamber 39, and permits fluid to flow between pressure chamber 26 and sensor chamber 39.

When differential pressure across diaphragm 22 is sufficient to overcome the bias of TXV set spring 36, diaphragm 22 and temperature sensor 30 move downward forcing fluid out of the pressure chamber 26 and through the flow passage 40.

The temperature sensor 30, with its large diameter, is intended to help heat transfer from the refrigerant in the sensor chamber 39 (and to a certain extent in the pressure chamber 26) to the charge chamber 24. Its inclusion is optional, especially when there is sufficient convection heat transfer in the pressure chamber 26. The inclusion of the sleeve 37 is also optional. There are also designs where the boundary between the sensor chamber 24 and the pressure chamber 26 is not distinct, with the passage 40 being wide open.

Figure 3:
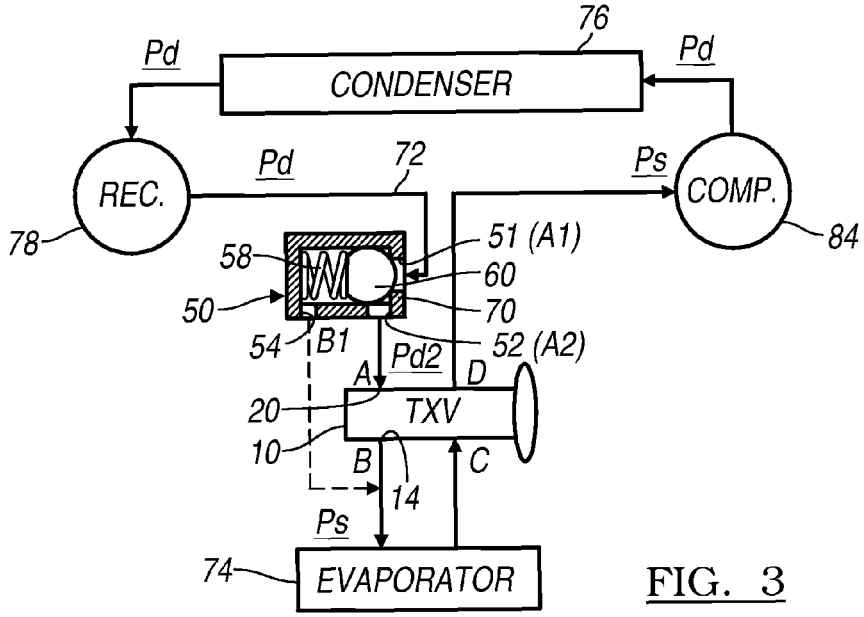
FIG. 3 is a schematic diagram of an air conditional system that includes a thermostatic expansion valve and a sequence valve.

A sequence valve (SV) 50 opens the liquid line port 20 (Port A) permitting fluid to flow into TXV 10 only after the system has reached a predetermined system pressure differential dPsys (dPsys=Pd−Ps, where Pd is the discharge pressure, Ps the suction pressure), thus achieving slower/smaller overall effective valve opening and a fair amount of sub-cool and/or vapor absorption within the liquid line 72, which is shown in FIG. 3.

The sequence valve 50 is directly integrated within the valve body 12 of TXV 10, as shown in FIG. 1, and includes a SV member 60 and a SV set spring 58 situated inside a SV spring chamber 59. The sequence valve 50 is interconnected with the TXV 10 and AC circuit through inlet port 51 (Port A1), outlet port 52 (Port A2) and back-pressure port 54 (Port B1), which are located downstream of liquid line port 20 (Port A) in the embodiment illustrated in FIG. 1. Outlet port 52 is in fluid communication with the TXV spring chamber 106. Back-pressure port 54 of the sequence valve 50 communicates evaporator inlet port 14 to a SV spring chamber 59. The status and extent of the valve opening is controlled by the force balance on the SV member 60 among the SV set spring force, the pressure force from the inlet port 51, and the back-pressure force from the SV spring chamber side.

Figure 2:
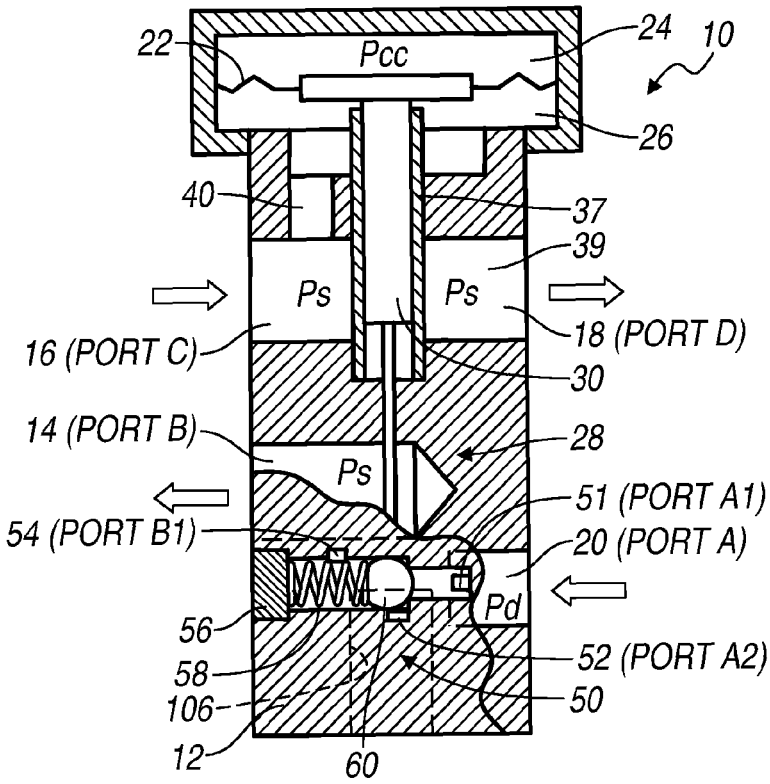
FIG. 2 is a cross section view through a thermostatic expansion valve having a perpendicularly integrated sequence valve.

In FIG. 1, sequence valve 50 is arranged generally parallel with the TXV 10 or the valve assembly 28. But sequence valve 50 can be arranged perpendicular to TXV 10, as shown in FIG. 2. A spring plug 56 can be used optionally as a set screw to adjust the preload on the SV set spring 58. Fine adjustment of the SV set spring preload is believed to be generally unnecessary because the sequence valve opening timing does not have to be as accurate as the superheat setting of a TXV valve.

Figure 5:
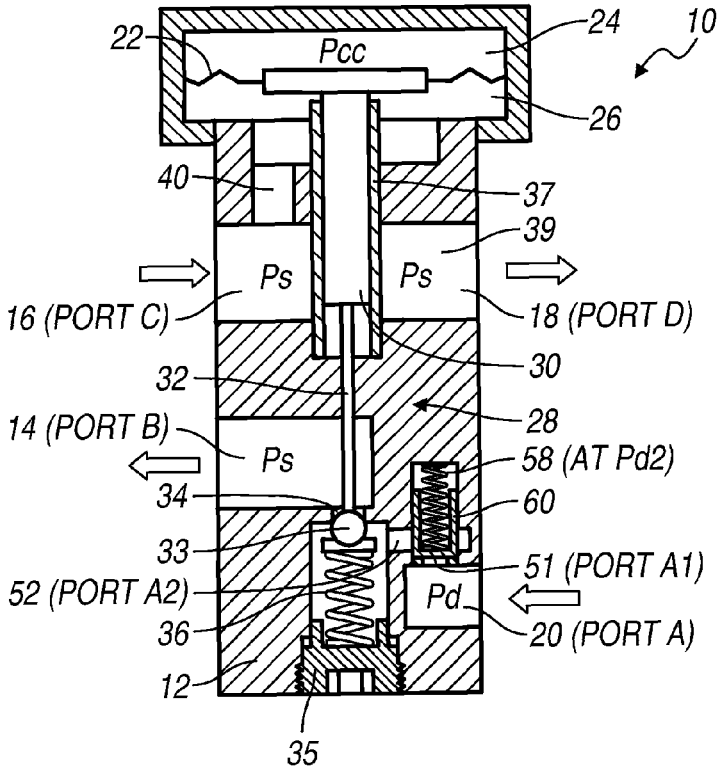
FIG. 5 is cross sectional view of a second embodiment through a thermostatic expansion valve with the sequence valve member being of a shape of a plug, instead of that of a ball.

The sequence valve member 60 can be a ball, as shown in FIGS. 1 and 2, a plug as shown in FIG. 5, or another construction or shape. SV set spring 58 urges the sequence valve member 60 to close the sequence valve 50.

Referring now to FIG. 3, an air conditioning system includes a TXV 10, the opening of which is slowed or delayed. Instead of directly interfering with pressure in pressure chamber 26 to delay the opening of the TXV valve member 28, the system includes sequence valve 50, which opens the inlet or liquid line port 20 and thus fluid flow to the TXV 10 only after the system has reached a predetermined system pressure differential dPsys, thus achieving slower/smaller overall effective valve opening and a fair amount of sub-cooling and/or vapor absorption within the liquid line 72.

The sequence valve 50 is housed in a valve body 70 and includes SV valve member 60 and SV set spring 58. The SV valve body 70 is formed with ports 51, 52, 54, which are in fluid communication with the liquid line 72, TXV port 20 (Port A), and TXV evaporator inlet port 14 (Port B), respectively. Port 51 is at discharge pressure Pd. Back-pressure port 54 is at suction pressure Ps. Port 52 is at a pressure Pd2, which varies between Pd and Ps depending on the opening status and extent of sequence valve 50 and the TXV 10.

The position and movement of the SV valve member 60 is controlled by a combination of the pressure forces on all sides of the SV valve member and the spring force from the SV set spring 58. In this case as shown in FIG. 3, the pressure forces are proportional to the system pressure differential dPsys. For simplicity, in this specification, the insignificant pressure drop in several components is ignored, including the pressure drop in the evaporator 74, condenser 76, receiver and drier 78, and the channels and tubing that interconnect these components. The SV set spring 58 has a preload. The SV valve member 60 becomes unseated and opens valve 50 when dPsys is greater than a predetermined pressure magnitude, dPsyso. When sequence valve 50 is open, high pressure refrigerant flows to port 51 (Port A1) to port 52 (Port A2) and port 20 (Port A), enabling the normal thermal expansion regulation function of the TXV.

Operation is described with reference to FIGS. 1, 3, 4A and 4B. The system pressure differential dPsys 80 starts to increase at 82 (time t1) following engagement of a clutch that transmits power to compressor 84. Thereafter, discharge pressure Pd 86 increases above the initial system pressure Po 85, and suction pressure Ps 88 decreases below the initial system pressure 85. The TXV charge pressure Pcc in chamber 26 starts its slow decline toward the saturation pressure at the evaporator outlet temperature. In a conventional TXV, the pressure chamber 26 has a pressure that closely follows the suction pressure Ps 88. The TXV valve member 33, therefore, is controlled by a TXV pressure differential 89 dPtxv defined as dPtxv=Pcc−Ps. The diaphragm 22 is effectively an actuator in response to the pressure differential between the charge pressure and the suction pressure.

Figure 4A:
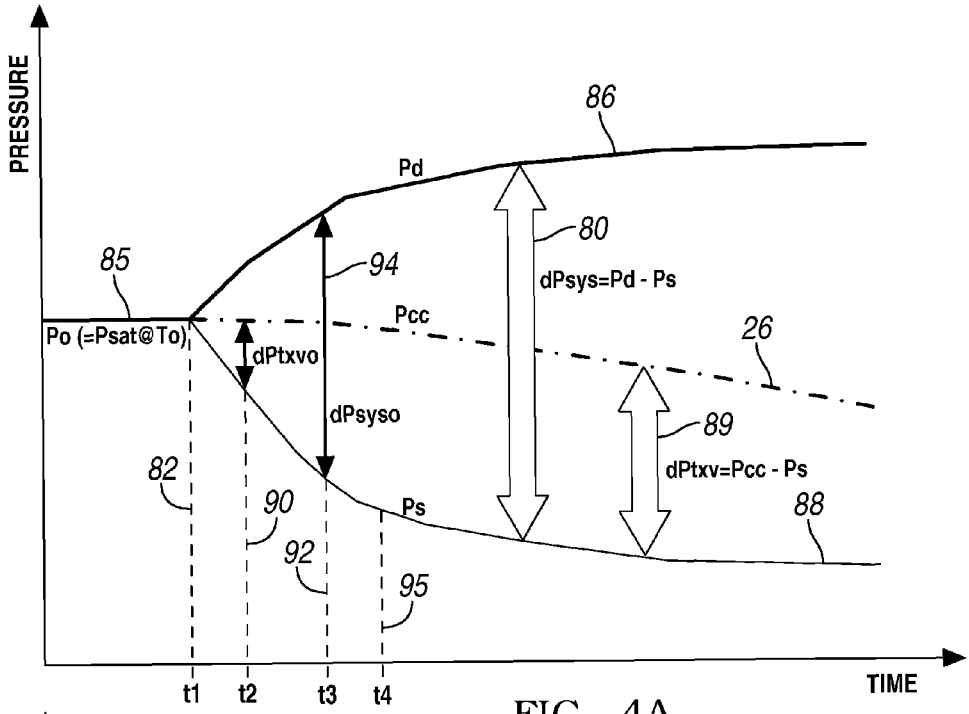
FIGS. 4A and 4B are graphs, which show the variation of system pressures and flow areas over time for the system of FIG. 3.
Figure 4B:
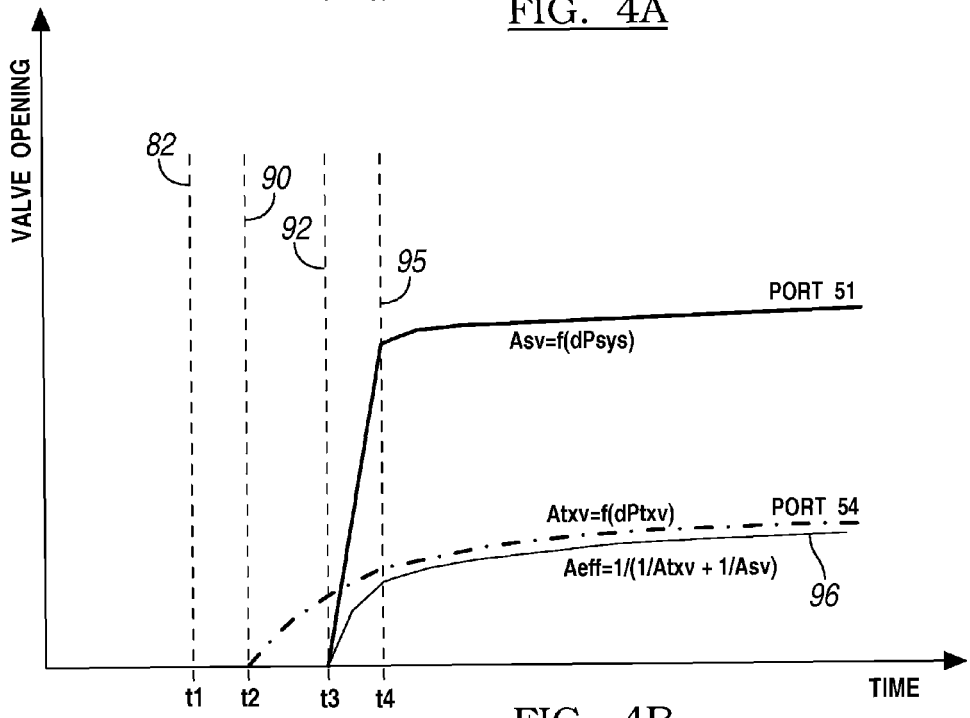

At 90 (time t2), dPtxv reaches a reference pressure differential dPtxvo, which is enough to force diaphragm 22 downward and to open the TXV valve member 33 against the preload of the TXV set spring 36. As shown in FIG. 4B at 90, the TXV opening area Atxv at port 34 starts showing a positive value.

At 92 (time t3), dPsys reaches a set value dPsyso 94, which is enough to open the SV valve member 60 at port 51 against the preload of the SV set spring 58. As shown in FIG. 4B at 92, the SV valve opening area Asv starts showing a positive value. Asv is primarily the metering area at the interface between the SV valve member 60 and port 51 (Port A1), and its effective value is also affected by the size or opening area of port 52 (Port A2), especially if Port A2 is relatively small.

Optionally, a predetermined spring stiffness value for the SV set spring 58 can be determined such that it causes the sequence valve 50 to reach its saturation valve opening area within a short period of time, e.g., at 95 (time t4). Also, it is possible for area Asv to have a saturation value that is much higher than that of Atxv so that the effective valve opening area Aeff, defined here as 1/(1/Atxv+1/Asv), is substantially equal to Atxv after time 95 (time t4). With this optional design, one can retrofit an existing TXV 10 with a sequence valve 50, without impacting current steady state operation or calibration. The effective valve opening area 96 (Aeff), as defined here, reflects the entire effect of both Atxv and Asv on the refrigerant throttling process, ignoring other minor losses.

Between 90 (time t2) and 92 (time t3), i.e., while the TXV 10 is open, the sequence valve 50 is closed, and Aeff=0, there is no fluid flow or hissing noise. Between 92 (time t3) and 95 (time t4), i.e., while both the TXV 10 and sequence valve 50 are open and Atxv>Aeff>0, there is refrigerant flow and throttling, which occurs, however, is under a more pressurized or sub-cooled condition and through an effective area Aeff that is smaller than the corresponding Atxv area alone. In this condition, the system generates substantially less hissing noise. Optionally, one can design the SV set spring to have a lower stiffness to extend or prolong the period between 92 (t3) and 95 (t4), and reduce the SV saturation valve opening to lower the effective area Aeff even further.

When the clutch is disengaged and power is not transmitted to compressor 84, the sequence valve 50 will close as soon as dPsys 80 drops to the set value dPsyso 94, thereby helping to close the refrigerant circuit, which is required by most, if not all, applications.

Figure 6:
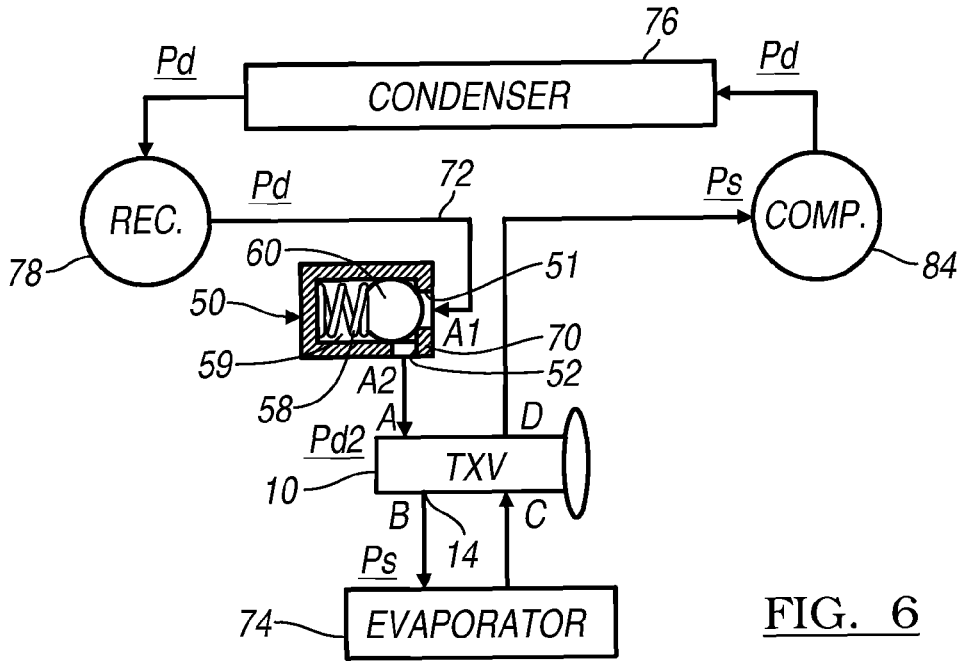
FIG. 6 is a schematic diagram of an air conditional system that includes a thermostatic expansion valve and a sequence valve, but without port B1.

In an alternate embodiment shown in FIG. 6, the sequence valve 50 includes no back-pressure port 54 (Port B1), and pressure in the SV spring chamber 59 and the TXV spring chamber 106 (inside the TXV 10 as illustrated in FIG. 1) is equalized during steady state at a pressure Pd2, which is equal to or greater than the suction pressure Ps when the sequence valve 50 is closed and open, respectively. With this design, the sequence valve 50 participates more in the refrigerant throttling process, even in steady state. The hissing noise decreases with multi-stage throttling.

Figure 7:
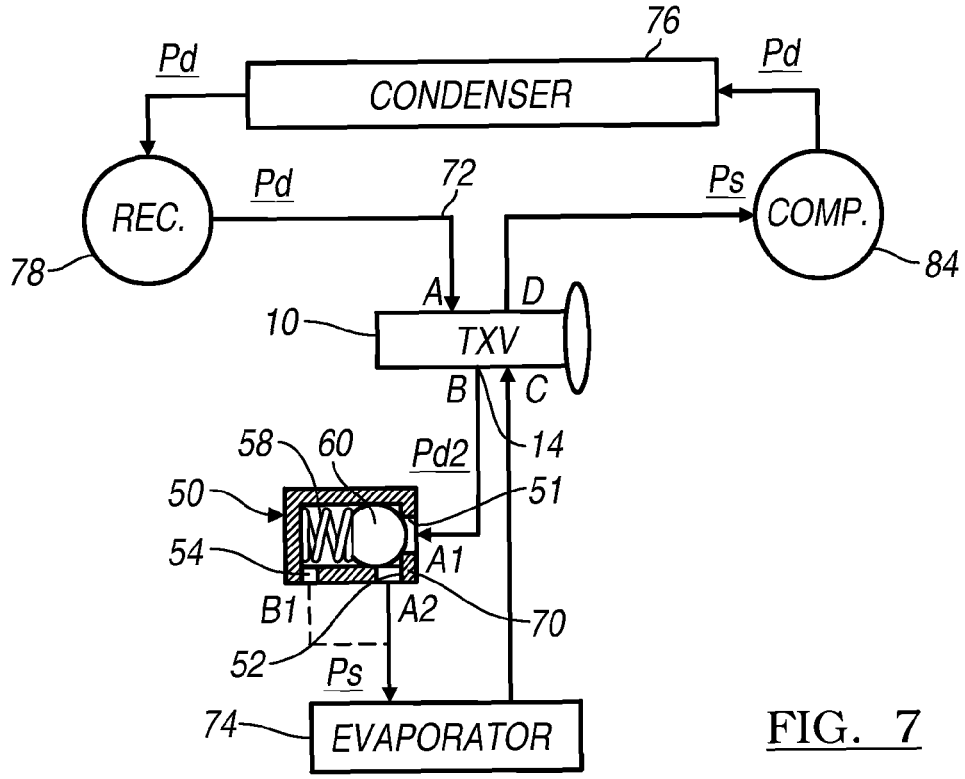
FIG. 7 is a schematic diagram of an air conditional system that includes a sequence valve located between a thermostatic expansion valve and evaporator.

In an alternate embodiment shown in FIG. 7, the sequence valve 50 is located between the TXV 10 and the evaporator 74. The sequence valve 50 is downstream of port 14 (Port B) when not integrated with the traditional TXV. When the sequence valve 50 is integrated with the TXV 10, preferably valve 50 is located upstream of port 14 (Port B) and downstream of the TXV valve member 33. In the arrangement of FIG. 7, back-pressure port 54 (Port B1) can be optionally eliminated, and the SV set screw 35 of FIG. 5 may be optionally included.

Alternatively, the sequence valve 50 embodiments described above can be replaced with electrical or solenoid valves. Preferably, the electrical valves open and close gradually, instead of being abruptly turned on and off, in order to avoid hydraulic transient or "water hammer."

The opening size or cross sectional area of back-pressure port 54 (Port B1) is preferably small so that it creates a substantial flow restriction, resulting in a damping effect on potential vibration or oscillation of the SV valve member 60. Proper sizing of the clearance between the SV valve member 60 and the SV spring chamber 59 may have a similar effect.

The opening size of each of inlet port 51 (Port A1) and outlet port 52 (Port A2) is preferably relatively small to help break bubbles and reduce the hissing noise, but not so small as to add too much restriction to the flow.

Figure 8:
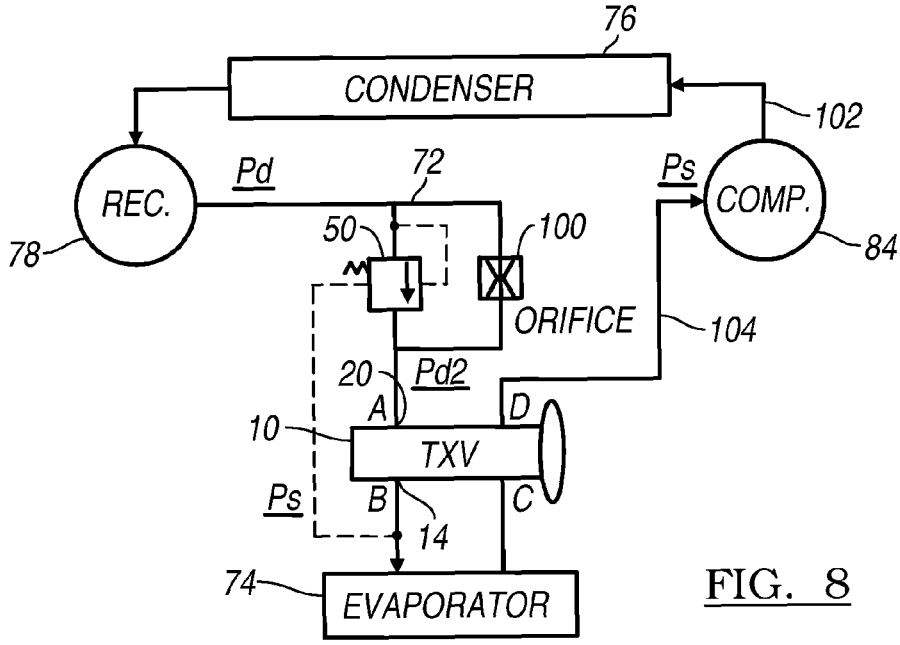
FIG. 8 is a schematic diagram of an air conditional system that includes an orifice in parallel with a sequence valve.

The alternate embodiment shown in FIG. 8 illustrates schematically the addition of an orifice 100, which provides a restrictive flow path in parallel with the sequence valve 50. Orifice 100 is always open and its flow area is constant. Due to the presence of orifice 100, TXV 10 is able to open the air conditioning circuit, in a limited fashion, even when the sequence valve 50 is not yet open. Orifice 100 helps prevent compressor 84 from overcharging the discharge side 102 and overdrawing the suction side 104. The limited flow metering area of orifice 100 allows a limited flow rate, but not enough to cause substantial hissing noise.

Figure 9:
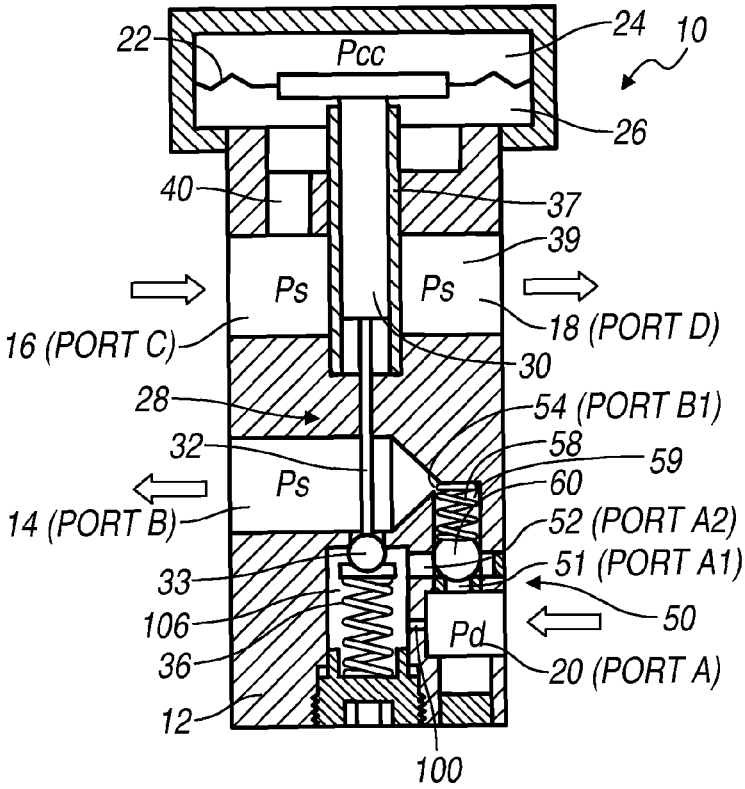
FIG. 9 is a cross section view through a thermostatic expansion valve having an orifice in parallel with a sequence valve.

In the integrated arrangement of FIG. 9, orifice 100 is located between port 20 (Port A) and the TXV spring chamber 106 providing limited fluid flow that bypasses the sequence valve 50.

Figure 10:
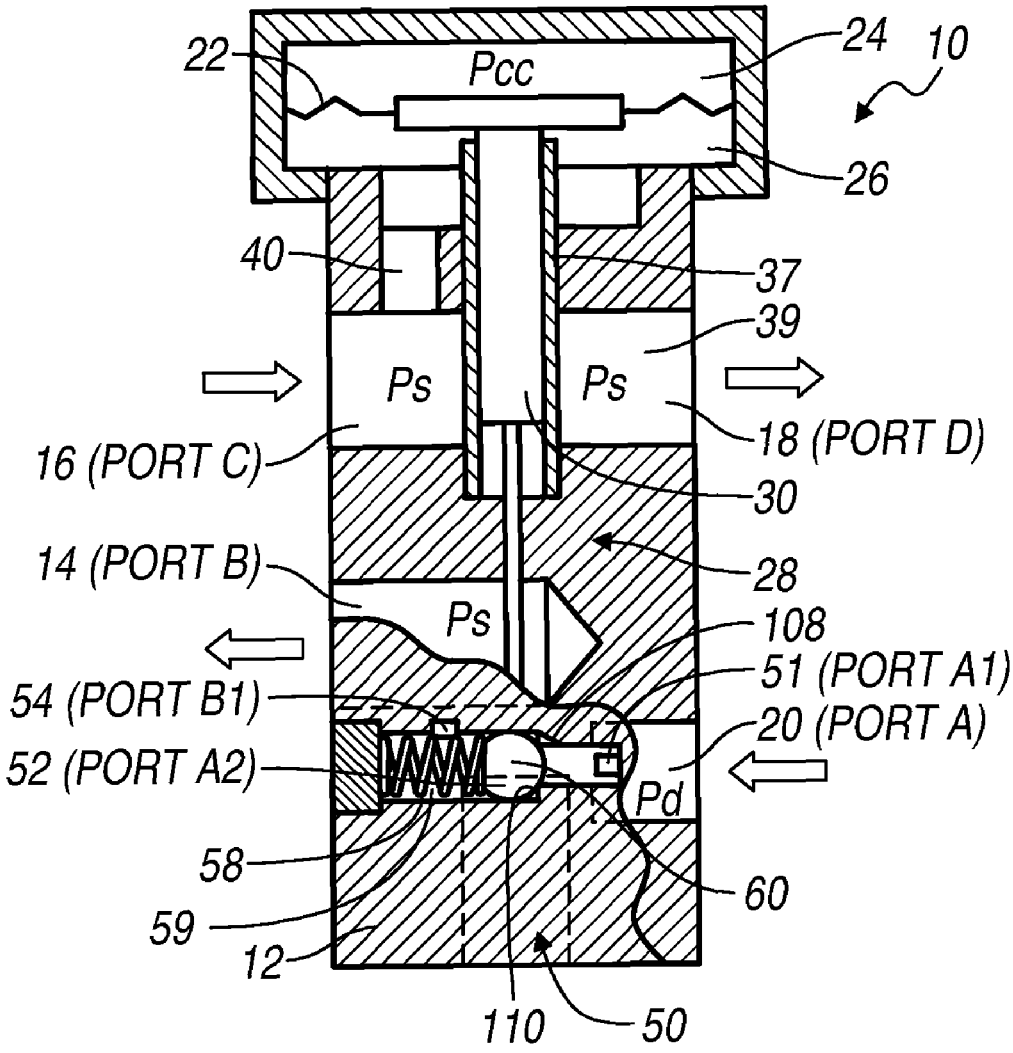
FIG. 10 is a cross section view through a second embodiment of a thermostatic expansion valve having an orifice in parallel with a sequence valve.

In the integrated alternate embodiment shown in FIG. 10, one or more grooves 108 are cut on the seat 110 around the sequence valve member 60, creating a desired leakage even when the valve member 60 is fully seated.

Figure 11A:
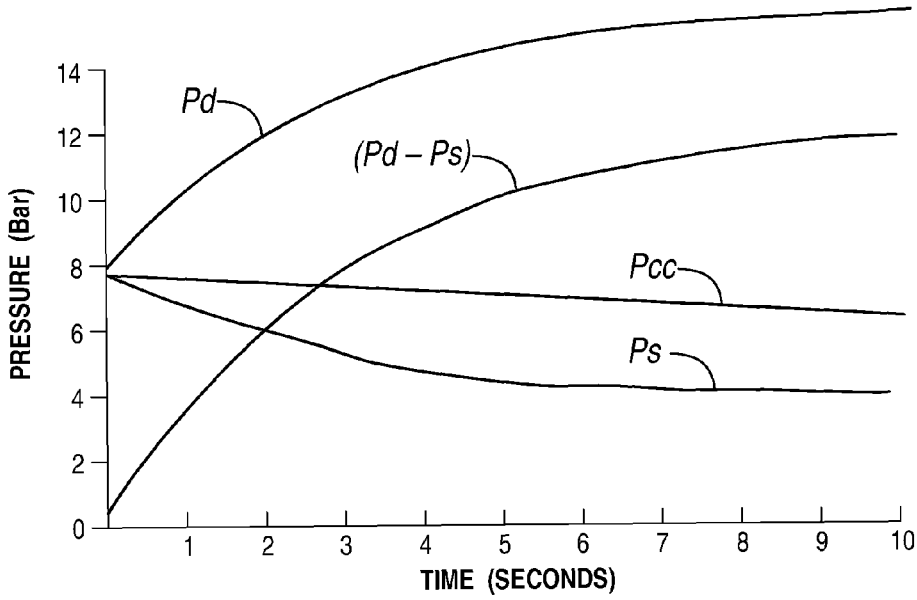
FIGS. 11A and 11B are graphs that show the variation of system pressures and flow areas, respectively, over time for the system of FIG. 10.
Figure 11B:
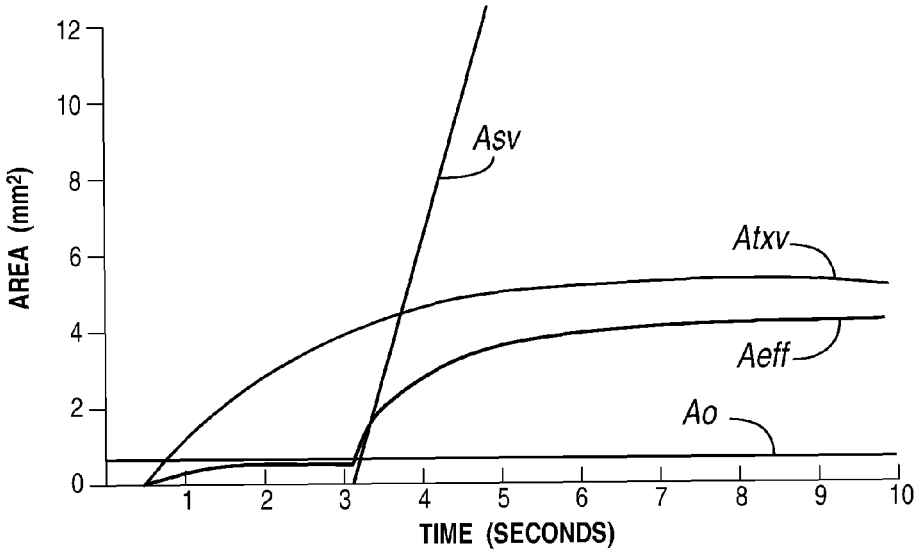

FIGS. 11A and 11B illustrate the variation with time of pressures and flow areas of the embodiments of FIGS. 8 and 9. In this case, the diameter of orifice 100 is 1.0 mm. and the orifice flow area Ao is constant 0.79 $mm^2$. At about 0.5 seconds after the compressor is activated, the TXV valve member 33 starts to open and its area Atxv rises rapidly. At about 3.0 seconds, the system pressure differential (Pd−Ps) reaches a predetermined cracking value (in this case about 8 Bar), the sequence valve starts to open, and its area Asv rises rapidly. The rising rate in this case can be adjusted to a lower value by providing a sequence valve set spring 58 having a lower spring rate. The total effective area (or metering area) Aeff is as follows:

$$Aeff=1/(1/Atxv+1/(Asv+Ao))$$

Aeff is substantially equal to Ao during the first three seconds, falls between Ao and Atxv during the next few seconds, and approaches Atxv at steady state.

Therefore, one is able to achieve a substantially reduced effective metering area within the first five to six seconds, without interfering with the steady function of the normal TXV part of the assembly.

In accordance with the provisions of the patent statutes, the preferred embodiment has been described. However, it should be noted that the alternate embodiments can be practiced otherwise than as specifically illustrated and described.

The invention claimed is:

1. A valve assembly for an air conditioning system, the valve assembly comprising:

a liquid line port pressurized at a discharge pressure, an evaporator inlet port pressurized at a suction pressure, and an outlet port between the liquid line port and the evaporator inlet port;

a sequence valve located downstream of the liquid line port and upstream of the outlet port, the sequence valve regulating a first flow path between the liquid line port and the outlet port in response to a differential between the discharge pressure and the suction pressure; and a thermostatic expansion valve located downstream of the outlet port and upstream of the evaporator inlet port, the thermostatic expansion valve including an actuator that moves in response to a pressure differential between a charge pressure and the suction pressure, and an expansion valve member that regulates a second flow path between the outlet port and the evaporator inlet port in response to movement of the actuator.

2. The valve assembly of claim 1 further comprising:

a TXV spring chamber that is open to the evaporator inlet port when the expansion valve member opens the second flow path;

a TXV set spring located in the TXV spring chamber for urging the expansion valve member to close the second flow path; and an orifice that continually connects the liquid line port and the TXV spring chamber.

3. The valve assembly of claim 1 wherein the sequence valve further includes:

an inlet port through which fluid flows between the liquid line port and the outlet port;

a valve seat;

a sequence valve member for engaging the valve seat and closing the inlet port, and for disengaging the valve seat and opening the inlet port; and a SV set spring for urging the sequence valve member toward engagement with the valve seat.

4. The valve assembly of claim 1 wherein the sequence valve further includes:

an inlet port through which fluid flows between the liquid line port and the outlet port;

a valve seat;

a sequence valve member for engaging the valve seat and closing the inlet port, and for disengaging the valve seat and opening the inlet port;

a SV spring chamber; and a SV set spring located in the SV spring chamber for urging the sequence valve member toward engagement with the valve seat and providing a pre-determined resistance to achieve a sequencing function.

5. The valve assembly of claim 1 wherein the sequence valve further includes:

an inlet port through which fluid flows between the liquid line port and the outlet port;

a valve seat;

a sequence valve member for engaging the valve seat and closing the inlet port, and for disengaging the valve seat and opening the inlet port;

a SV spring chamber;

a SV set spring located in the SV spring chamber for urging the sequence valve member toward engagement with the valve seat and providing a pre-determined resistance to achieve a sequencing function; and a back-pressure port that connects the SV spring chamber and the evaporator inlet port.

6. The valve assembly of claim 1 wherein the sequence valve further includes:

an inlet port through which fluid flows between the liquid line port and the outlet port;

a valve seat formed with a groove;

a sequence valve member for disengaging the valve seat and substantially opening the inlet port, and for engaging the valve seat and substantially closing the inlet port, with the groove still permitting a limited fluid flow past the valve seat;

a SV spring chamber; and a SV set spring located in the SV spring chamber for urging the sequence valve member toward engagement with the valve seat and providing a pre-determined resistance to achieve a sequencing function.

7. A valve assembly for an air conditioning system, the valve comprising:

a valve body including a liquid line port pressurized at a discharge pressure and an evaporator inlet port pressurized at a suction pressure;

a sequence valve located within the valve body and including an inlet port through which fluid flows from the liquid line port into the valve body, a valve seat, a sequence valve member for engaging the valve seat and closing the inlet port and for disengaging the valve seat and opening the inlet port, a SV spring chamber, a SV set spring located in the SV spring chamber and urging the sequence valve member toward engagement with the valve seat, and an outlet port able to communicate with the liquid line port when the inlet port is open; and a thermostatic expansion valve located within the valve body and including an actuator that moves in response to a pressure differential between a charge pressure and the suction pressure, and an expansion valve member that regulates a flow path between the outlet port and the evaporator inlet port in response to movement of the actuator.

8. The valve assembly of claim 7 wherein the sequence valve regulates a connection between the inlet port and the outlet port in response to a differential between the discharge pressure and the suction pressure.

9. The valve assembly of claim 7 further comprising a back-pressure port connecting the SV spring chamber and the evaporator inlet port.

10. The valve assembly of claim 7 further comprising:

a TXV spring chamber that is open to the evaporator inlet port when the expansion valve member opens the flow path;

a TXV set spring located in the TXV spring chamber for urging the expansion valve member to close the flow path; and an orifice that continually connects the liquid line port and the second spring chamber.

11. The valve assembly of claim 7 wherein:

the valve seat is formed with a groove; and the sequence valve member opens and closes the inlet port in a manner such that the groove permits fluid flow past the valve seat even when the sequence valve member engages the valve seat.

12. A valve assembly for use in an air conditioning system that includes:

a compressor whose intake side is pressurized at a suction pressure and discharge side is pressurized at a discharge pressure, a condenser communicating with the discharge side and with a liquid line port, and an evaporator communicating with the intake side and with an evaporator inlet port, comprising:

a sequence valve including an inlet port through which fluid flows from condenser outlet side, a sequence valve member for controlling the inlet port, and an outlet port that connects the condenser outlet side and the liquid line port when the inlet port is open; and a thermostatic expansion valve including an actuator that moves in response to a pressure differential between a charge pressure and the suction pressure, and an expansion valve member that controls a flow path between the outlet port and the evaporator inlet port in response to movement of the actuator.

13. The valve assembly of claim 12 wherein:

the sequence valve further includes a valve seat, a SV spring chamber, a SV set spring located in the SV spring chamber for urging the sequence valve member toward engagement with the valve seat, and the sequence valve member closes the inlet port by engaging the valve seat and opens the inlet port by disengaging the valve seat

14. The valve assembly of claim 12 wherein:

the sequence valve further includes a valve seat, a SV spring chamber, a SV set spring located in the SV spring chamber for urging the sequence valve member toward engagement with the valve seat, and the sequence valve member closes the inlet port by engaging the valve seat and opens the inlet port by disengaging the valve seat; and further comprising a back-pressure port connecting the SV spring chamber and the evaporator inlet port.

15. The valve assembly of claim 12 further comprising:

an orifice arranged in a parallel with the sequence valve between the liquid line port and an outlet side of the condenser.

16. A valve assembly for use in an air conditioning system that includes:

a compressor whose intake side is pressurized at a suction pressure and discharge side is pressurized at a discharge pressure, a condenser communicating with the compressor discharge side and with a liquid line port, and an evaporator communicating with the compressor intake side and with an evaporator inlet port, comprising:

a thermostatic expansion valve including an actuator that moves in response to a pressure differential between a charge pressure and the suction pressure, and an expansion valve member that controls a flow path between the liquid line port and an thermostatic expansion valve outlet; and a sequence valve located in series flow relationship between the thermostatic expansion valve and the evaporator, including an inlet port through which fluid flows from the thermostatic expansion valve outlet, a sequence valve member for controlling the inlet port, and an outlet port that connects the evaporator inlet port.

17. The valve assembly of claim 16 wherein:

the sequence valve further includes a valve seat, a SV spring chamber, a SV set spring located in the SV spring chamber for urging the sequence valve member toward engagement with the valve seat, and the sequence valve member closes the inlet port by engaging the valve seat and opens the inlet port by disengaging the valve seat; and further comprising a back-pressure port connecting the SV spring chamber and the evaporator inlet port.

* * * * *